US005993167A

United States Patent [19]

Mochizuki

[11] Patent Number: 5,993,167

[45] Date of Patent: Nov. 30, 1999

[54] APPARATUS AND METHOD FOR ENERGY CONVERSION OF PRESSURIZED FLUID

[76] Inventor: Takuo Mochizuki, 2-10-2, Koyo, Niigata, Japan

[21] Appl. No.: 08/754,247

[22] Filed: Nov. 20, 1996

[30] Foreign Application Priority Data

Jun. 26, 1996 [JP] Japan ..... 8-166014

[51] Int. Cl.[6] ..... F04F 5/00

[52] U.S. Cl. ..... 417/174; 417/196; 417/151

[58] Field of Search ..... 417/151, 174, 417/196

[56] References Cited

U.S. PATENT DOCUMENTS

| | | | |
|---|---|---|---|
| 250,073 | 11/1881 | Hudson | 417/84 |
| 368,691 | 8/1887 | See | 114/184 |
| 436,932 | 9/1890 | Best | 417/174 |
| 550,244 | 11/1895 | Blagburn | 417/174 |
| 694,002 | 2/1902 | Davis | 406/153 |
| 2,616,614 | 11/1952 | Plummer, Jr. | 230/95 |
| 2,632,597 | 3/1953 | Boeckeler | 230/92 |
| 5,478,209 | 12/1995 | McDomough | 417/174 |
| 5,628,623 | 5/1997 | Skaggs | 417/151 |

FOREIGN PATENT DOCUMENTS 54-42682 12/1979 Japan .

*Primary Examiner*—Charles G. Freay
*Assistant Examiner*—Ehud Gartenberg
*Attorney, Agent, or Firm*—Wenderoth, Lind & Ponack, L.L.P.

[57] ABSTRACT

A method of and apparatus for momentum exchange of a pressurized fluid including a jet nozzle for discharging a jet of pressurized fluid produced by a pressure pump, a first inlet opening provided downstream of the jet nozzle, an air layer generating pipe, and a momentum exchange tube disposed downstream of the air layer generating pipe. A layer of air, around a highly pressurized fluid released from the jet nozzle, is formed by the air layer generating pipe. The momentum exchange tube is formed of a substantially straight construction and has an inner diameter which is greater than an inner diameter of the air layer generating pipe. An outlet provided at the momentum exchange tube for using, as a lifting elevation, the pressure produced by urging the pressurized fluid against air in the momentum exchange tube. The lifting force is calculated through dividing the pressure of the pressurized fluid by a ratio of the inner diameter of the momentum exchange tube and the diameter of the jet nozzle aperture, and multiplying the resultant value by an inertial force of the pressurized fluid.

1 Claim, 7 Drawing Sheets

APPARATUS AND METHOD FOR ENERGY CONVERSION OF PRESSURIZED FLUID

BACKGROUND OF THE INVENTION

The present invention relates to a method and an apparatus for momentum exchange of a pressurized fluid in which a jet of highly pressurized water is released and its kinetic energy is used for sucking and delivering a fluid including solids, producing a negative pressure for a suction dehydrator apparatus, and transferring from a lower location to a higher.

It is known that a pressure feeder apparatus such as a tube pump is used for sucking and delivering a slurry, concrete milk, or the like including solids. The negative pressure for the suction dehydrator apparatus is commonly developed by means of a venturi type negative pressure generator apparatus.

Such a tube pump or pressure feeder apparatus for delivering a flow containing solids has a resilient tube arranged so as to be deformable by a roller for reducing its cross sectional area through which a given volume of slurry or concrete milk is transferred under pressure. The negative pressure generator apparatus of any venturi type is designed for blowing a jet of pressurized fluid into a venturi and increasing the speed of the fluid enough to produce a negative pressure in the venturi.

The tube pump type pressure feeder apparatus allows the resilient tube to be pressed down by the roller for reducing the cross sectional area, thus increasing the possibility of clogging the resilient tube with the solids contained in the fluid and lowering the operational reliability of the apparatus. Also, as the fluid is forwarded or delivered intermittently, its maximum volume per unit time will be limited.

The tube pump type pressure feeder apparatus is varies in cross sectional area and this will become critical if air (gas) enters the system. Once a flow of air enters the pressure feeder apparatus, it will be compressed hence which will reduce the feeding efficiency and interrupt the feeding action of the apparatus. For several years this has been recognized as a fundamental drawback of common pumps throughout the worldwide industries.

The venturi type negative pressure generator apparatus produces a reduced or negative pressure due to the Bernoulli effect by blowing a jet of pressurized fluid from a jet nozzle into a venturi or throat passage at a near-sonic speed. Although the negative pressure is successfully produced and utilized, the venturi or throat passage of such a jet pump installation will also produce undesirable effects including turbulence and cavitation.

For maintaining a desired feeding efficiency of the jet pump installation, the cross section of the pressurized fluid to be forwarded through it has to remain compatible with the inner diameter of the venturi or throat passage. It is thus necessary for aligning the cross section of the pressurized fluid with the inner diameter of the venturi or throat passage to determine the proper settings of the diameter of the jet nozzle aperture for producing a jet of the pressurized fluid as well as the pressure of a pressurizing pump according to the requirements of the job to be performed.

However, even when the cross section of the pressurized fluid has been maintained compatible with the inner diameter of the venturi or throat passage, and the settings of the diameter of the jet nozzle aperture for producing a jet of the pressurized fluid and the pressure of the pressurizing pump have been determined, there is still a problem. As the negative pressure is produced in the venturi or throat passage, the negative pressure acts as a back pressure against the venturi or throat passage and varies with changes in the volume of the fluid. This prevents the jet pump form liquid from consistently and efficiently producing the negative pressure.

Further, the alignment of the cross section of the pressurized fluid with the inner diameter of the venturi or throat passage is quite difficult and can be effected only by the use of relevant data, knowledge, and skill which have been accumulated since the first introduction of the liquid jet pump.

In addition, an extra portion of the negative pressure has to be calculated as developed outside of the venturi or throat passage. However, when a conduit through which the pressurized fluid is passed is enlarged radially and gradually towards exit end of the conduit, the cross section of the pressurized fluid becomes greater, and thus the reference point for the calculation and to establish any mathematical formula for a practical use cannot be established. Therefore, conventional pressure feeder apparatuses such as liquid jet pumps are only designed on the basis of relevant data, measurements, and rules which have been gained through experience.

If a slurry which includes solids is pumped upward by the liquid jet pump for dredging, its specific gravity may be great enough to cause cavitation, and some of the solids may come into direct contact with or strike the jet nozzle and venturi or throat. The higher the pressure of a jet fluid, the greater resulting damage.

It is common for minimizing cavitation and damage to the inner walls of the jet pump to limit the pressure (including the negative suction pressure and the feeding pressure) used in the pump to pressures in a relatively low range.

As the liquid jet pump is operated under this limited condition, its operating capability will be unstable with changes in any of the nozzle jet pressure, the nozzle aperature diameter, the throat inner diameter, and the distance between the jet nozzle and the entrance of the throat.

If the pressure of the pressurized fluid is increased, its cross section will be enlarged due to the effects of cavitation, and thus cross section will exceed the inner diameter of the entrance of the throat. As a result, a part of the fluid will run backward in the throat or pressure reduction passage and cause solids contained therein to damage the entrance of the throat. To eliminate this problem, the structural balance between the diameter of the aperture of the jet nozzle and the inner diameter of the entrance of the throat has to be determined with great care. Accordingly, a design of the liquid jet pump is assigned to a specific application, and thus its usage as a unit will be limited to a very small range of industrial operations.

The inventor of the present invention has reviewed the fact that an entry of air in the compression or pressure feeder apparatus which varies the volume of a fluid is critical because the air is compressed which reduces or interrupts the efficiency of feeding the fluid. After intensive study of the movement of a jet of water in a water jet pump in relation to the flow of air introduced intentionally, a variety of air mixed type jet pumps were developed in the 1980s for the purpose of solving the foregoing drawbacks.

Since the air mixed type jet pumps were first invented, over 20 years have passed. The air mixed type jet pumps have been modified and improved in order to satisfy a wide range of applications by trying to eliminate the substantial drawbacks including instability of fluid transfer, friction along the inner wall, and cavitation.

The air mixed type jet pumps which were invented and disclosed by the present inventor taught only about the pump's theoretical construction, arrangement, and application usage. Unfortunately, no mathematical formulas for implementing the previous inventions were developed. The air mixed type jet pumps hence are not widely accepted because they are based, like the conventional liquid jet pumps, on relevant data, measurements, and rules gained through a series of experimental applications.

It may be true that the previously developed air mixed type jet pumps invented by me have novel constructions and the functions and advantages thereof are not clearly verified by appreciable theoretical statements that undertake an intended operation.

Since the entry of air in any conventional jet pump is one of the most important conditions to avoid, the air mixed type of jet pumps may not be accepted and utilized widely in the related industries unless the construction, function, and advantages thereof can be proved by a rational explanation with theoretical statements.

It is an object of the present invention to describe the advantages of an air mixed type jet pump having a novel construction, which is very different from any of the conventional jet pumps, and arranged such that its operational performance can be calculated with theoretical statements in order to meet a variety of applications.

SUMMARY OF THE INVENTION

In order to achieve the above object, an apparatus for momentum exchange of a pressurized fluid according to the present invention is provided and comprises a jet nozzle for blowing a jet of pressurized fluid produced by a pressure pump, and a momentum exchange tube communicating with the jet nozzle by an inlet opening provided downstream of the jet nozzle. The momentum exchange tube has a discharge opening provided downstream thereof. When the highly pressurized fluid, released from the jet nozzle, is discharged with a layer of air around it to urge against the interior air in the momentum exchange tube, its pressure is used as a lifting elevation force at the discharge opening. The lifting elevation force is calculated by dividing the pressure of the pressurized fluid by the difference between the inner diameter of the momentum exchange tube and the diameter of an aperture of the jet nozzle which results in a first value, and multiplying the resulting first value by an inertial force of the discharged fluid which is achieved by multiplying the mass and velocity of the water mist. Also, the inner diameter of an air layer generator piping of a substantially linear configuration is greater than the diameter of an aperture of the jet nozzle. The momentum exchange tube is formed of a substantially straight construction and has an inner diameter which is greater than the inner diameter of the air layer generator piping.

The air layer generator piping provided between the jet nozzle and the inlet opening is communicated with an air intake inlet. Since the jet nozzle communicates with one end of the air layer generator piping, the pressurized fluid blown from it is accompanied with a flow of air which is introduced from the air intake inlet which forms the air layer around the pressurized fluid in the air layer generator piping. The length of a straight portion of the momentum exchange tube is preferably greater than three times the inner diameter of the same.

A method for momentum exchange of a pressurized fluid according to the present invention comprises the steps of forming a layer of air over the periphery of the pressurized fluid released from a jet nozzle, allowing the pressurized fluid with the air layer on it to run forward in an momentum exchange tube and to expand radially in the momentum exchange tube in response to a counter pressure or a positive pressure at the downstream of the pressurized fluid, wherein forming a turbulence flow (hereinafter called "imaginary piston") moving toward the exit end of the momentum exchange tube, causing the imaginary piston to develop a negative pressure on the jet nozzle side of the momentum exchange tube, and using a pressure developed downstream of the imaginary piston as a lifting force for pumping fluid or liquid.

The air layer is preferably formed over and along the pressurized fluid by blowing a jet of pressurized fluid from the jet nozzle into an air layer generator piping and applying, to the periphery of the pressurized fluid, a flow of air which is introduced from an air intake inlet to the air layer generator piping.

DETAILED DESCRIPTION OF THE PREFERRED EMBODIMENT

A method and an apparatus for momentum exchange of a pressure fluid according to the present invention will be described with reference to the accompanying drawings.

Figure 1:
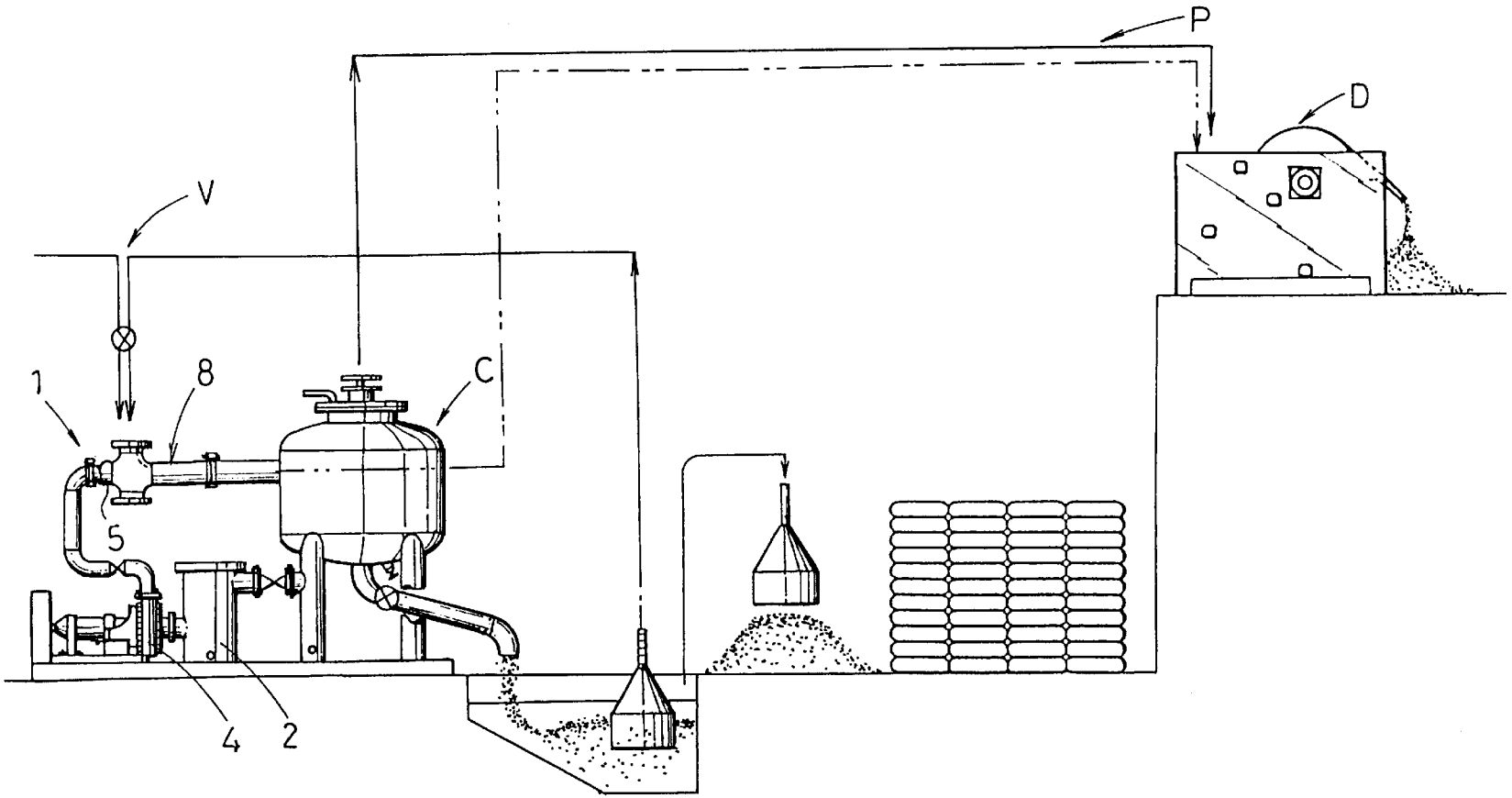
FIG. 1 is a schematic side view of a dredging system.

FIG. 1 is a schematic side view showing a dredging plant system which is denoted as a whole by P.

The dredging plant P comprises a suction feeder apparatus V for pumping up a slurry including solids and separating it into solid, gas, and liquid, and a dehydrator apparatus D for dehydrating the slurry fed from the suction feeder apparatus. The suction feeder apparatus V includes a gas mixed type jet pump 1 for delivering the slurry with solids pumped by the action of a negative suction pressure through a solid/gas/fluid separator apparatus C to the dehydrator apparatus D.

Figure 2:
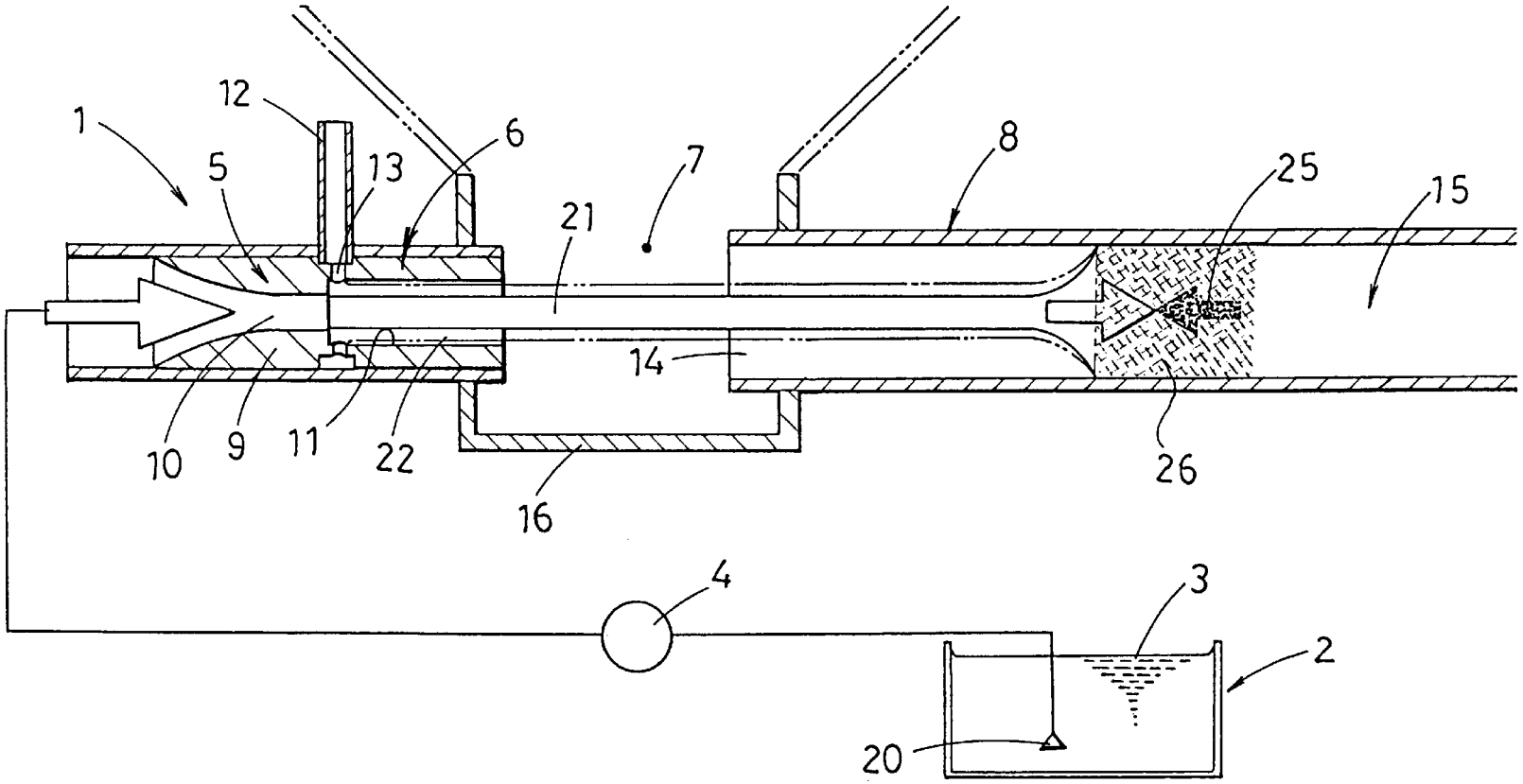
FIG. 2 is an enlarged cross sectional view of a nozzle of a jet pump.

The gas mixed type jet pump 1 comprises, as shown in FIGS. 1 and 2, a reservoir 2, a pressure pump 4 for pressurizing water (a fluid) 3 from the reservoir 2, a jet nozzle 5 for producing a jet of the pressured water, an air layer generator piping 6 disposed at the downstream side of the jet of the jet nozzle 5, and a momentum exchange tube 8 connected to the downstream side of the air layer generator piping 6 by a space 7.

The jet nozzle 5 and the air layer generator piping 6 are formed integrally with a casing 9.

More specifically, the jet nozzle 5 is defined by a small-diameter jet orifice 10 formed in the casing 9 of a round rod shape and extending from one end to an intermediate portion of the same. The air layer generator piping 6 has a jet flow passage 11 which is formed so as to be larger in diameter than the jet orifice 10 of the jet nozzle 5. The passage 11 extends from the intermediate portion to the other end of the casing 9. An air intake tube 12 is mounted at the jet nozzle end of the air layer generator piping 6 so as to communicate with the jet flow passage 11 through an air intake aperture 13.

Figure 3:
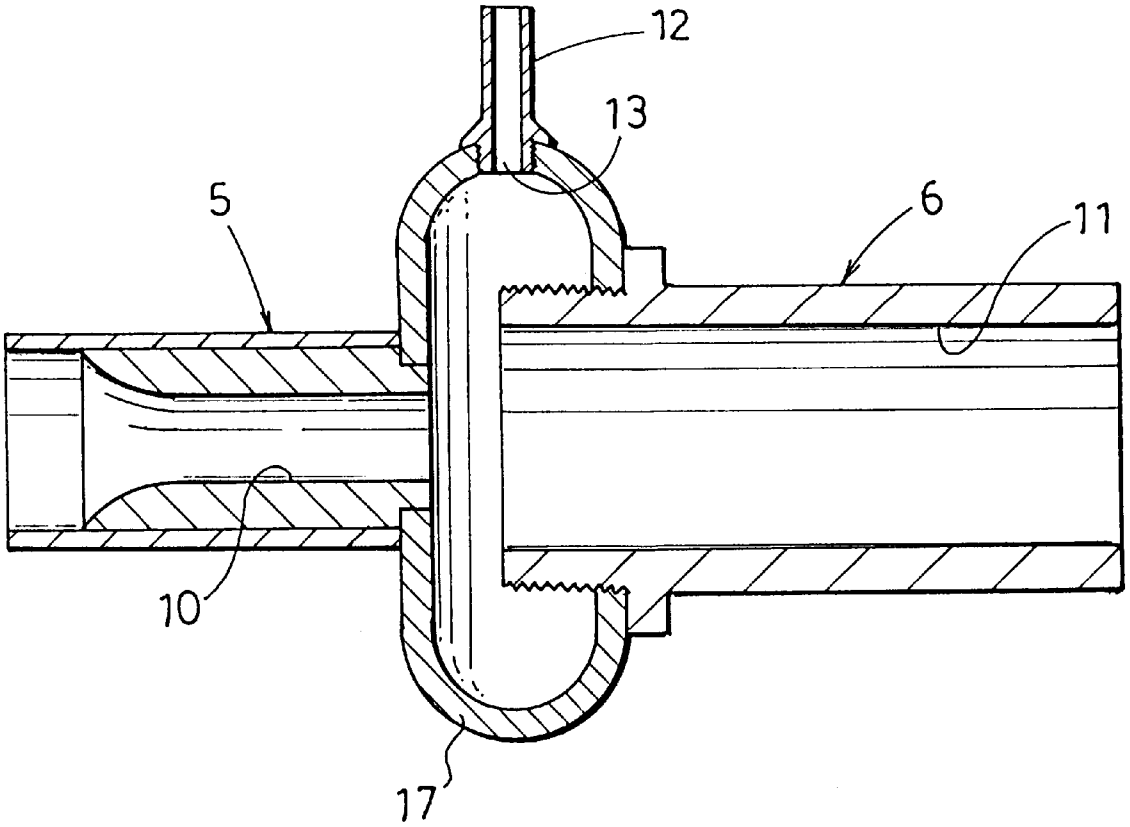
FIG. 3 is an enlarged cross sectional view of a modification of the nozzle of the jet pump.

Although the jet nozzle 5 and the air layer generator piping 6 are formed in the casing 9 in this embodiment, they may be provided separately as shown in FIG. 3, where the air intake tube 12 is coupled to a support member 17 which is interposed between the jet nozzle 5 and the air layer generator piping 6.

The momentum exchange tube 8 has a greater inner diameter than the air layer generator piping 6 and its straight region extends more than three times the opening diameter.

The opening at the air layer generator piping 6 side of the momentum exchange tube 8 is an inlet opening 14. An discharge opening 15 of the momentum exchange tube 8 is provided at a discharge end (not shown) downstream of an imaginary piston which will be explained later.

As shown, the air layer generator piping 6 and the momentum exchange tube 8 are connected to each other by a connecting member 16.

The operation of the air mixed type jet pump 1 will now be described.

The water 3 is drawn up through a strainer 20 from the reservoir 2 and pressurized by the action of the pressure pump 4. The resulting highly pressurized water or fluid is blown through the jet nozzle 5 into the air layer generator piping 6 (see FIG. 2).

Upon it being blown through the jet nozzle 5 into the air layer generator piping 6, the highly pressurized fluid runs as a jet flow 21 at a high speed throughout the air layer generator piping 6 thus producing a negative pressure in the jet flow passage 11 due to the Bernoulli effect. This allows external air to be introduced from the air intake tube 12 through the air intake aperture 13 and into the air layer generator piping 6.

The external air introduced into the air layer generator piping 6 is attracted by the jet flow 21 and thus will run along the jet flow 21. As denoted by the broken line in FIG. 2, the jet flow 21 is surrounded by an air layer 22 formed of the external air and is discharged into the momentum exchange tube 8.

The jet flow 21 in the momentum exchange tube 8 is separated by the air layer 22 from stationary interior air which is located outside of the jet flow 21, and remains stationary due to friction along the inner wall of the momentum exchange tube 8. Accordingly, the jet flow 21 is prevented from radially expanding and any reduction in its speed is minimized by the action of the air layer 22 which becomes thin very gradually.

As the jet flow 21 runs through the momentum exchange tube 8, when the air layer 22 around the jet flow 21 is faded or the pressurized jet flow 21 encounters a force of resistance 25 or a positive pressure at a downstream of the momentum exchange tube 8, the jet flow 21 expands radially as turbulence flow 26 and fills up the momentum exchange tube 8, whereby the turbulence flow 26 acts as an imaginary piston as indicated by the cross hatching in FIG. 2.

The development of the imaginary piston 26 will be explained in more detail below.

When the jet flow 21 is discharged, with the air layer 22 surrounding the jet flow 21, from the air layer generator piping 6 and expands radially upon encountering the resistance force 25 in the momentum exchange tube 8, it then turns into a multiplicity of mist drops 19. As the mist drops 19 continue to travel forward, a cluster of air 27 at the downstream side (the front) of each mist drop 19 is compressed as shown by the dotted area in FIG. 4.

As the air clusters 27 are pressed by the respective front ends of the mist drops 19 and are joined to each other, the inlet opening 14 side and the discharge opening 15 side are completely separated by the mist drops 19. Since the mist drops 19 are continuously moving towards the discharge end of the momentum exchange tube 8, their entirety constitutes the imaginary piston 26 which acts on continuously towards the discharge end of the momentum exchange tube 8.

The location of the imaginary piston 26, developed in the momentum exchange tube 8, may vary depending on the strength of the resistance force 25. Since the momentum exchange tube 8 is formed in a straight configuration, it rarely generates any abrupt change which may cause the negative pressure to be unstable as compared with the conventional radially expanding form such as of a diffuser.

Figure 5:
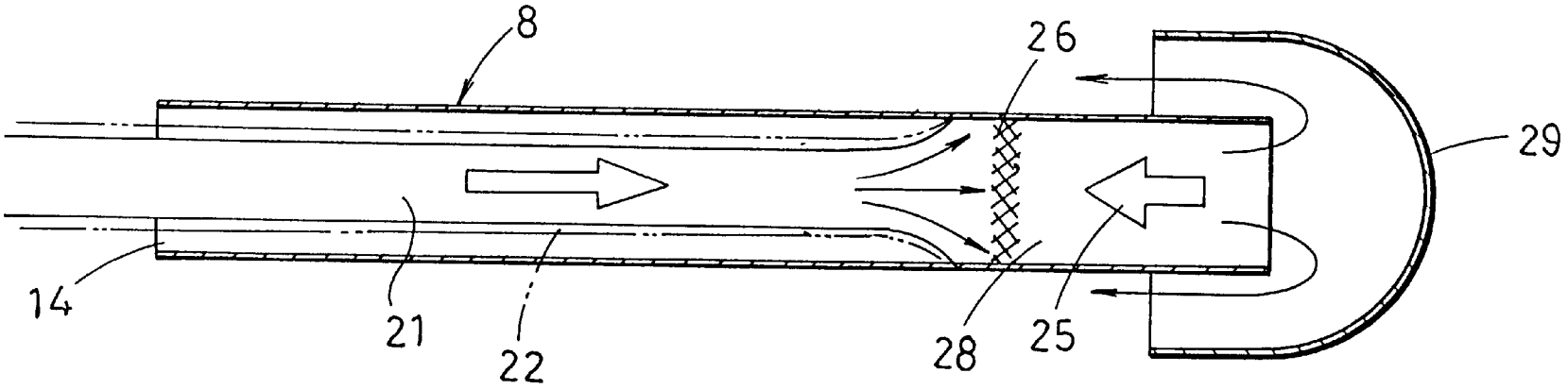
FIG. 5 is an enlarged cross sectional view of an arrangement for generating a resistance for development of the imaginary piston.
Figure 6:
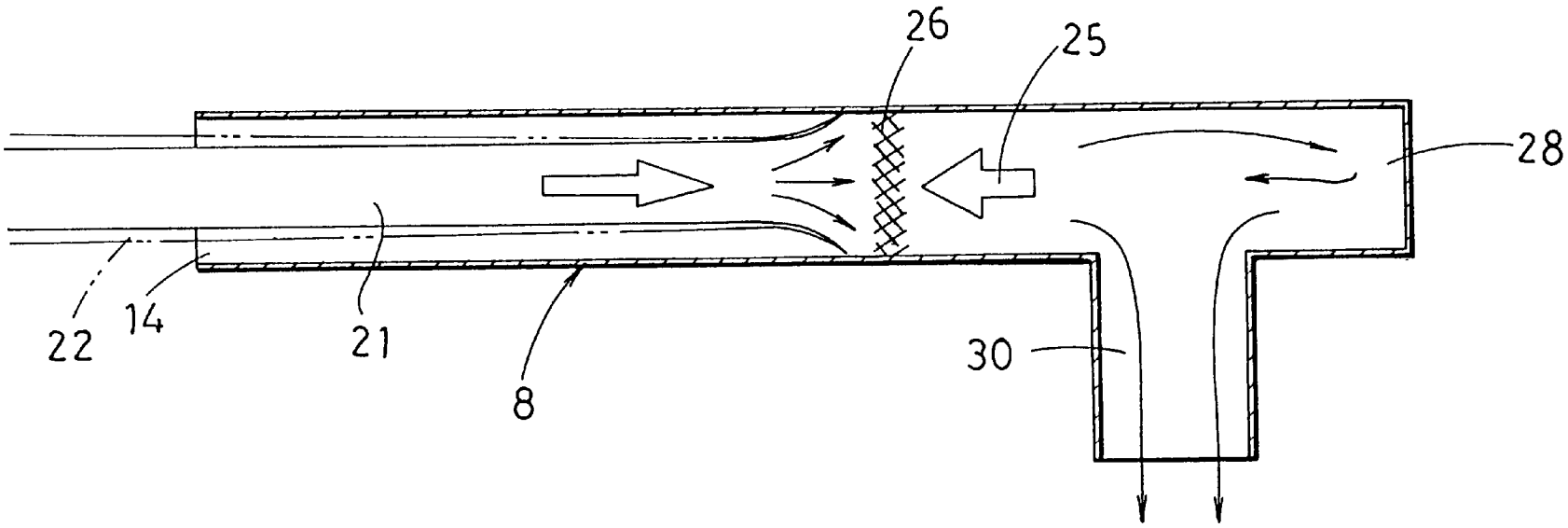
FIG. 6 is an enlarged cross sectional view of another arrangement for generating a resistance for development of the imaginary piston.
Figure 7:
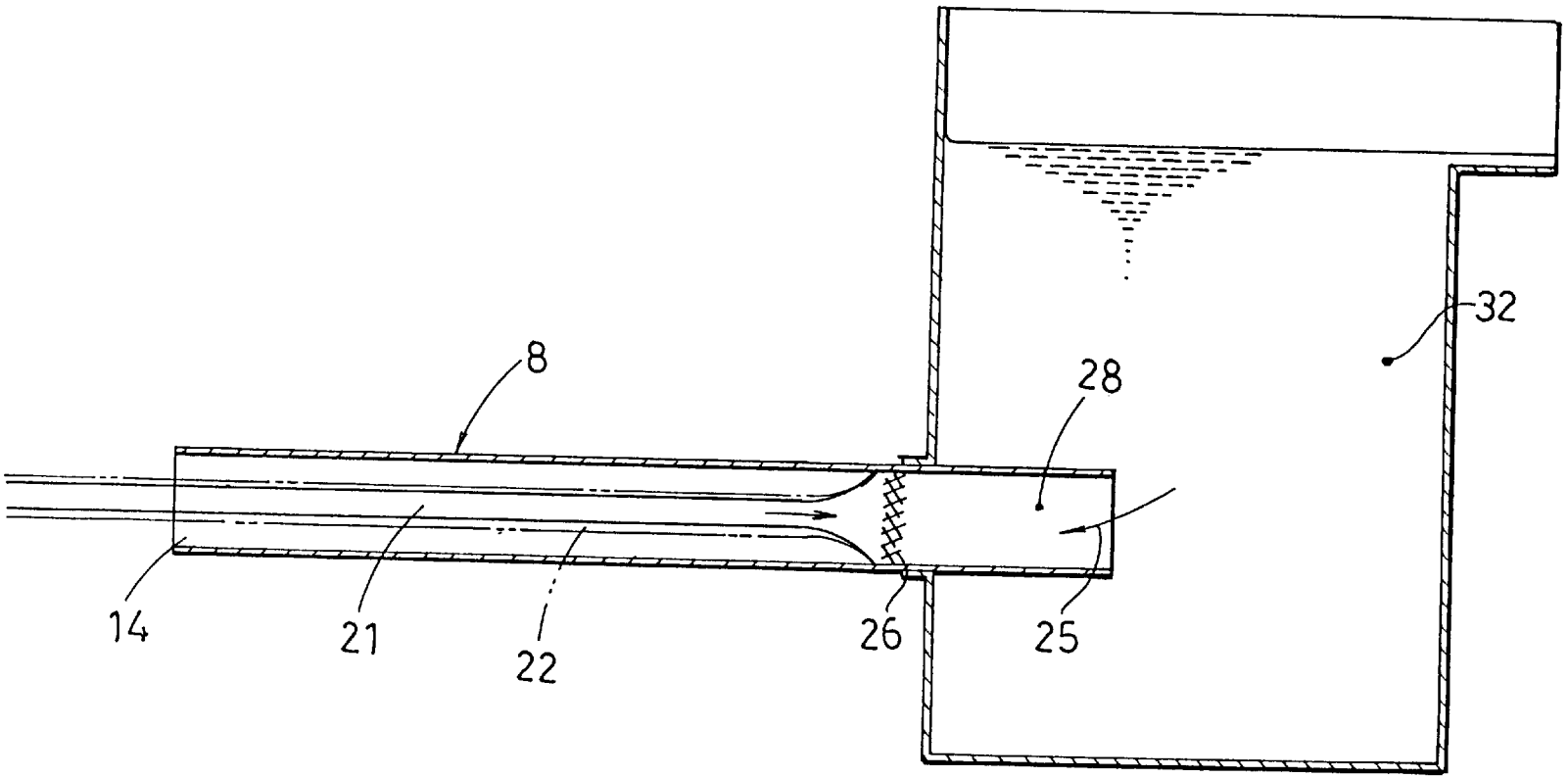
FIG. 7 is an enlarged cross sectional view of a further arrangement for generating a resistance for development of the imaginary piston.

In other words, the development of the imaginary piston 26 can be determined arbitrarily and located closer to the air layer generator piping 6 by increasing the resistance force 25 which acts against the jet flow 21 in the momentum exchange tube 8. The increasing or promoting of the resistance force 25 may be implemented by a reflector 29 disposed at the discharge end 28 of the momentum exchange tube 8 for providing a reflection effect as shown in FIG. 5. Also, the force 25 may increased by a discharge discharge 30 provided before the discharge end of the momentum exchange tube 8 which is closed in order to turn the jet flow 21 and simultaneously assist the resistance force 25 as shown in FIG. 6. And, by a liquid 32 exerting its weight when the discharge end 28 of the momentum exchange tube 8 is exposed and located in the liquid 32 as shown in FIG. 7. Also, when the momentum exchange tube 8 is shortened in length, the overall dimensions of the apparatus can be minimized.

While negative pressure is developed at the upstream side of the imaginary piston 26, the compression is created downstream of the same. The negative pressure at the upstream side is used for a suction force of the inlet opening 14. The suction force is used for suctioning slurry or for sucking water in the dehydrator apparatus D.

The compression at the downstream side of the imaginary piston 26 is used for driving the slurry under pressure from the discharge opening 15 to the solid/gas/liquid separator C of the centrifugal type, and used as a lifting elevation for elevating liquid from the solid/gas/liquid separator C to the dehydrator D located at a higher position.

The calculation of the lifting elevation for elevating the fluid from discharge opening 15 to the dehydrator D will now be explained.

The lifting elevation from the discharge opening 15 is calculated through dividing the pressure of the jet flow 21 by a ratio between the inner diameter of the momentum exchange tube 8 and the diameter of an aperture of the jet nozzle 5 to have a resultant value and multiplying the resultant value by an inertial force of the jet flow 21. The inertial force of the jet flow 21 is expressed by multiplication of the pressurized fluid (water) and the forwarding velocity.

The calculation is made from the following equations.

If the lifting elevation of a pressure pump is expressed in meters, the equation is:

$$\text{Lifting elevation } H=[p/(A1/A2)]\times vm\times c$$

wherein p is a pressure,

A1 is the cross sectional area of the momentum exchange tube as expressed in m2, A2 is the cross sectional area of the aperture of the jet nozzle as expressed in m2, vm is an inertial force of jet flow obtained by mutiplying a velocity(v) and mass of flow, and c is a correction factor of the density variation rate of an air mixed jet flow in consideration with the volumetric expansion due to compression and release in the momentum exchange tube.

When a pressure of jetting flow having one meter of lifting elevation is required, it necessitates a pressure of 0.1 kg per cm2. Accordingly, the equation for the lifting elevation is:

$$\text{Lifting elevation } H=[px10/(A1/A2)]\times vm\times c$$

wherein the lifting elevation is expressed in meters.

The volumetric expansion due to compression and release and the velocity energy inertial force for defining the density variation rate c are now explained.

Figure 4:
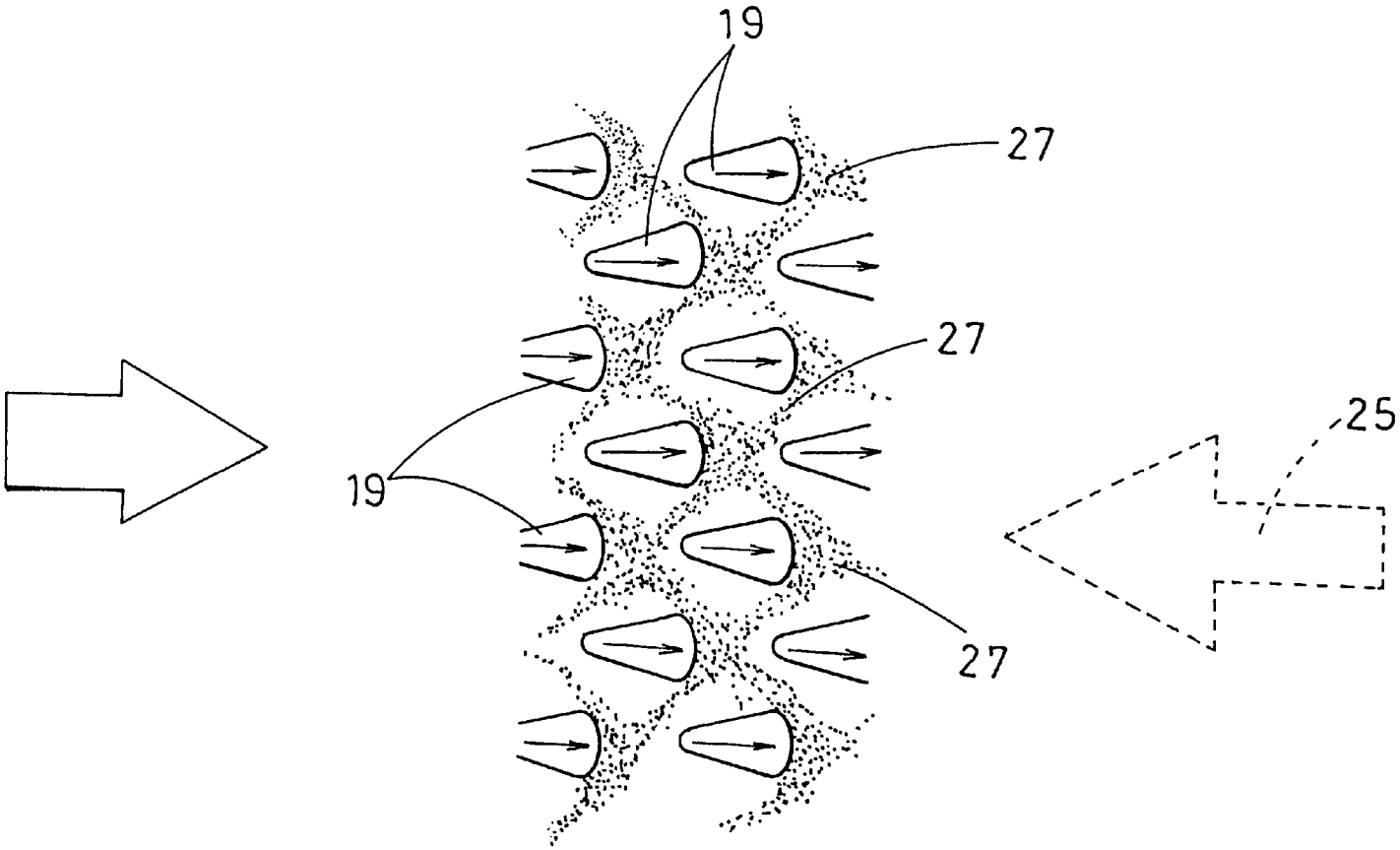
FIG. 4 is an explanatory view showing development of an imaginary piston.

Referring to FIG. 2, the clusters of air 27 shown in FIG. 4 are pressed by the imaginary piston 26 developed and forwarded together with the mist drops 19 to the discharge end 28 or the discharge opening 15 of the momentum exchange tube 8 where they are released and expanded in the volume.

Accordingly, the specific gravity of the jet flow 21 is reduced in the discharge opening 15 with a correction factor of the variation rate of an air mixed type jet pumps c of 1.85 in this embodiment.

As the air clusters have been expanded, the velocity of the mist drops 19 is accelerated thus virtually increasing the lifting elevation at the discharge opening 15. However, because the specific gravity is smaller than that of water, the actual lifting elevation is less than the virtually increased value.

If the lifting elevation H of the pressure pump is 3000 m (equivalent to 300 kg/cm2 of the pressure of the jet flow), the diameter of the jet nozzle aperture d2 is 5 mm, and the inner diameter of the momentum exchange tube d1 is 100 mm, the lifting elevation H is calculated from:

$$[300\times10/(0.00785/0.000019625)]\times1.85=13.875\text{ m}$$

using the previous equation. The lifting elevation of 13.875 m is then allowed.

The lifting amount of water Q is expressed by:

$$Q=[(d1-d2)\times(\sqrt{(h\times19.6)})]\times f\text{Å}$$

where fÅ is the slip rate of liquid in consideration with the resistance inside conduits. In this embodiment, fÅ is 0.5556. Hence, the equation is established by:

$$Q=\left[(0.0078304)\times\left(\sqrt{(13.875\times19.6)}\right)\right]\times60\times0.556=4.3047\text{ m3/min}$$

From the above values, the requirements in the apparatus for momentum exchange of a pressurized fluid are calculated as follows:

| | | |
|---|---|---|
| (1) Diameter of jet nozzle aperture | 5.00 | mm |
| (2) Pressure of jet flow | 300.00 | kg/cm2 |
| (3) Jet flow employed | 285.361 | l/min |

-continued

| | | |
|---|---|---|
| (4) Inner dia. of momentum exchange tube | 100.00 | mm |
| (5) Maximum lifting elevation | 13.88 | m |
| (6) Maximum pumping | 4.30 | m3/min |
| (7) True specific gravity | 2.60 | |
| (8) Void rate | 0.60 | |
| (9) Virtual specific gravity | 1.56 | |
| (10) Total specific gravity | 1.96 | |
| (11) Solid rate in suction | 30.00% | |
| (12) Solid rate in discharge | 28.13% | |
| (13) Specific gravity loss | 2.95 | m |
| (14) Jet flow | 0.29 | m3/min |
| (15) Total water and feed | 3.67 | m3/min |
| (16) Length of feed conduit | 50.00 | m |
| (17) Diameter of feed conduit | 200.00 | mm |
| (18) Friction coefficient in feed conduit | 0.80 | |
| (19) Velocity in feed conduit | 1.95 | m/sec |
| (20) Lost water head due to interior friction loss | 0.87 | m |
| (21) Total lifting elevation | 3.82 | m |
| (22) Possible lift (5–21) | 10.05 | m |
| (23) Head balance | 0.05 | m |
| (24) Final pumping | 3.12 | m3/min |
| (25) Liftable solid per minute | 0.94 | m3/min |
| (26) Liftable solid per day (8 w.hours) | 449.03 | m3/day |

In case that the lifting elevation H of the pressure pump is 50 m(equivalent to 5 kg/cm2 of the pressure of the jet flow), the diameter of the jet nozzle aperture d2 is 50 mm, and the inner diameter of the momentum exchange tube d1 is 100 mm, the lifting elevation H is calculated from:

$$[5\times10/(0.00005/0.000019625)]\times1.85=23.125\text{ m}$$

using the previous equation. The lifting up to 23.125 m is allowed.

The lifting amount of water Q is determined by:

$$Q=\left[(0.0058875)\times\left(\sqrt{(23.125\times19.6)}\right)\right]\times60\times0.556=4.1784\text{ m3/min}$$

From the above values, the requirements in the apparatus for momentum exchange of a pressurized fluid are calculated as follows:

| | | |
|---|---|---|
| (1) Diameter of jet nozzle aperture | 50.00 | mm |
| (2) Pressure of jet flow | 5.00 | kg/cm2 |
| (3) Jet flow employed | 3683.921 | l/min |
| (4) Inner dia. of momentum exchange tube | 100.00 | mm |
| (5) Maximum lifting elevation | 23.13 | m |
| (6) Maximum pumping | 4.18 | m3/min |
| (7) True specific gravity | 2.60 | |
| (8) Void rate | 0.60 | |
| (9) virtual specific gravity | 1.56 | |
| (10) Total specific gravity | 1.96 | |
| (11) Solid rate in suction | 30.00% | |
| (12) Solid rate in discharge | 15.94% | |
| (13) Specific gravity loss | 3.07 | m |
| (14) Jet flow | 3.68 | m3/min |
| (15) Total water and feed | 7.31 | m3/min |
| (16) Length of feed conduit | 100.00 | m |
| (17) Diameter of feed conduit | 200.00 | mm |
| (18) Friction coefficient in feed conduit | 0.80 | |
| (19) Velocity in feed conduit | 3.88 | m/sec |
| (20) Lost water head due to interior friction loss | 6.91 | m |
| (21) Total lifting elevation | 9.98 | m |
| (22) Possible lifting elevation (5–21) | 13.15 | m |
| (23) Head balance | 3.15 | m |
| (24) Final pumping | 2.38 | m3/min |
| (25) Liftable solid per minute | 0.71 | m3/min |
| (26) Liftable solid per day (8 w.hours) | 340.80 | m3/day |

As set forth above, the apparatus for momentum exchange of a fluid of the present invention is capable of providing a desired lifting elevation or pumping amount with the diameter of the jet nozzle aperture which is decreased when the lifting elevation (a jet fluid pressure) of the pressure pump is high or increased when it is low. The lifting elevation can be calculated with ease and accuracy.

In other words, the fluid momentum exchange apparatus of a desired capability is produced by determining the diameter of the jet nozzle aperture and/or the inner diameter of the momentum exchange tube in relation to the jet nozzle aperture diameter according to the present invention. The apparatus for momentum exchange of a fluid of the present invention is capable of having as a high pumping efficiency as has never before been expected.

Although the air layer 22 is formed over the jet flow 21 from the jet nozzle 5 in the air layer generator piping 6 of the embodiment, it may be applied in the momentum exchange tube 8 into which the jet flow 21 is directly introduced from the jet nozzle 5.

What is claimed is:

1. A method of making a jet pump for momentum exchange of a pressurized fluid with a pumped fluid, said method comprising:

providing a jet nozzle for discharging a jet of pressurized fluid produced by a pressure pump, said jet nozzle having an outlet aperture;

providing an air layer generating pipe in communication with a downstream end of said jet nozzle for forming a layer of air surrounding the pressurized fluid from said jet nozzle, said air layer generating pipe being substantially linear and coaxial with said jet nozzle, and having an inner diameter which is greater than a diameter of the outlet aperture of said jet nozzle; and providing an inlet for pumped fluid downstream of said air layer generating pipe;

providing a substantially straight momentum exchange tube disposed downstream of said inlet for the pumped fluid, said momentum exchange tube having an inlet opening in communication with said jet nozzle, said air layer generating pipe, and said inlet for the pumped fluid, wherein substantially straight momentum exchange tube further includes an outlet opening, and an inner diameter which is greater than the inner diameter of said air layer generating pipe, dimensioning said jet nozzle aperture, said air layer generating pipe, and said momentum exchange tube such that a desired lifting elevation for elevating a pumped fluid from said outlet opening is obtained, wherein the dimensions of said jet nozzle aperture, said air layer generating pipe, and said momentum exchange tube satisfy the following relationship:

$$H=[P/(A1/A2)]\times vmc$$

where H is the desired lifting elevation, P is a lifting elevation of the pressure pump, representing the pressure of the pressurized fluid, A1/A2 is a ratio of the cross-sectional area of said momentum exchange tube to the cross-sectional area of the outlet aperture of said jet nozzle, and vmc is a density variation rate of the pressurized fluid.

* * * * *